United States Patent [19]

Simon

[11] Patent Number: 4,700,601

[45] Date of Patent: Oct. 20, 1987

[54] PUNCH PIN HEAD STRUCTURE

[75] Inventor: Gary J. Simon, San Jose, Calif.

[73] Assignee: Velo Bind Inc., Sunnyvale, Calif.

[21] Appl. No.: 856,396

[22] Filed: Apr. 28, 1986

[51] Int. Cl.[4] ..... B26F 1/14

[52] U.S. Cl. ..... 83/687; 30/366; 83/441.1; 83/622; 83/626

[58] Field of Search ..... 30/360, 361, 366, 363, 30/164.5–164.8; 83/441.1, 626, 687, 622, 467, 686

[56] References Cited

U.S. PATENT DOCUMENTS

| | | | |
|---|---|---|---|
| 1,863,801 | 6/1932 | Lorber | 30/164.6 |
| 3,191,462 | 6/1965 | Plunske | 30/368 X |
| 4,077,288 | 3/1978 | Holland | 83/687 |
| 4,079,647 | 3/1978 | Elder et al. | 83/441.1 |

*Primary Examiner*—Douglas D. Watts
*Attorney, Agent, or Firm*—Julian Caplan

[57] ABSTRACT

Punches for paper and the like have a metal pin having a male punch element formed on one end and a pressure application area on the opposite end. To withdraw the punch pin an enlargement is formed at or near the opposite end, the enlargement cooperating with a gripper or a spring in the punch to cause the pin to retract when the pressure applicator retracts. In accordance with the present invention a circumferential groove is formed in the punch pin and a collar of plastic material is formed around the pin protruding into said groove and functioning as the enlargement.

1 Claim, 5 Drawing Figures

PUNCH PIN HEAD STRUCTURE

BACKGROUND OF INVENTION

1. Field of Invention

This invention relates to a new and improved punch pin having a plastic collar molded thereon which cooperates with a spring or a retractor gripper in the punch mechanism to retract the pin after it has performed its punching operation.

2. Description of Related Art

Various means have been employed to incorporate collars in punch pins. Where the collar is located on the end of the pin, upsetting has commonly been the means of fabrication. Another type of collar has been provided by forming a circumferential groove in the pin and inserting therein a D-ring or equivalent.

The present invention provides a collar at a cost much less than upsetting the pin end and less expensive and more secure than the use of a D-ring or similar fastener.

SUMMARY

In one form of punch illustrated generally herein, the application of force to the punch pin is at the top. The member applying force is formed with a slot having inward extending shoulders which fit under the collar on the pin. In this form of the invention, the plastic collar is molded to the pin at the upper end thereof, there being a groove formed in the pin spaced downward from its upper end into which a portion of the molded material protrudes.

In another form of punch herein illustrated, the application of force is from the end of the pin. Retraction is accomplished by a coil spring which bears against a collar spaced down from the upper end of the pin. In this form of the invention, the groove in the pin is spaced downward a greater distance than the groove in the preceding modification. However, the collar is fabricated in essentially the same manner as in the preceding modification.

Other objects of the present invention will become apparent upon reading the following specification and referring to the accompanying drawing in which similar characters of reference represent corresponding parts in each of the several views.

DESCRIPTION OF PREFERRED EMBODIMENTS

Figure 1:
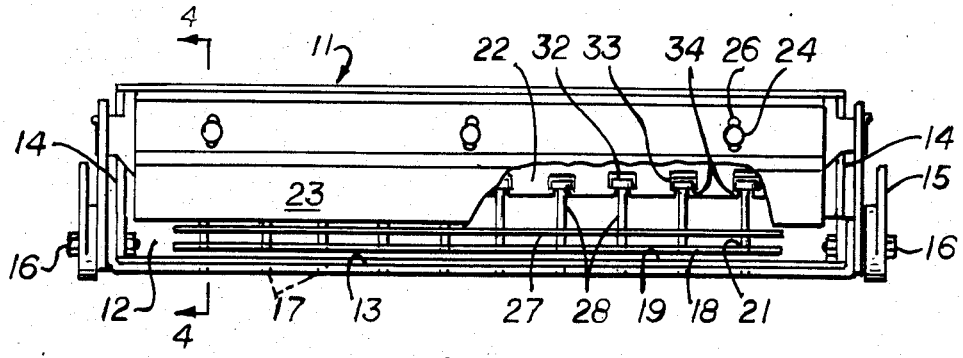
FIG. 1 is a front elevational view of one form of punch partially broken away to reveal internal construction.

FIG. 1 shows a portion of the paper punch more completely illustrated and described in U.S. Pat. No. 4,079,647. Punch 11 is manually actuated by a handle (not shown) which, through linkage, causes the lever 15 to oscillate about a horizontal transverse axis. The front plate 23 of punch 11 is formed with a punch opening 12 for reception of the paper to be punched. Spaced rearwardly from the plate 23 is a horizontally extending female die plate 13 secured to side plates 14. Holes 17 are formed in plate 13, the number and spacing of which determines the number, spacing and size of the holes to be punched in the paper. Immediately above plate 13 is a horizontal transverse guide plate 18 and there is a gap 19 between plates 13 and 18 which limits the quantity of paper which can be punched at one time. Plate 18 is formed with holes 21 which are aligned with holes 17.

Vertically reciprocating punch plate 22 is in vertical alignment with holes 17 and 21. Immediately in front of plate 22 is front plate 23. Pins 24 pass through slots 26 in the plate 13 and through plate 22 in such manner that the plate 22 may reciprocate relative to the stationary elements of the punch apparatus.

Male punch pins 28, which are in the form of round cross-section rods, are in vertical alignment with holes 17 and 21. The lower ends 29 of pins 28 are ground concave so as to cooperate with the holes 17 to punch paper in the gap 19. The upper end of each pin 24 is formed with an enlarged head 32 which is received in a slot 33 in punch plate 22. Below slots 26 are inward extending shoulders 34 integral with plate 22 which engage under the heads 32. Thus, as plate 22 is depressed each head 32 of pin 28 is depressed by the top of slot 33 engaging the top of head 32. Actuation of vertical reciprocation of punch plate 22 is by oscillation of crank 15 in a manner described in detail in said U.S. Pat. No. 4,079,647. Other means of reciprocation are acceptable.

Figure 3:
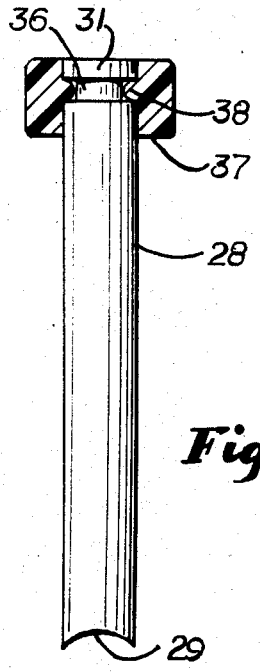
FIG. 3 is a section thereof taken substantially along the line 3—3 of FIG. 1.
Figure 2:
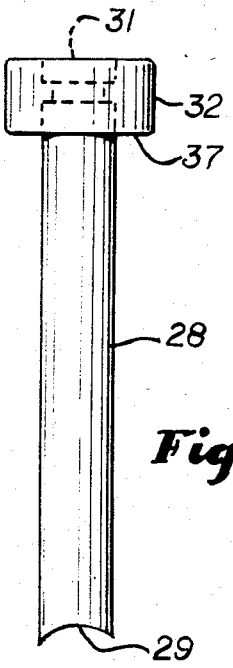
FIG. 2 is an enlarged elevational view of the pin of FIG. 1.

Directing attention now to FIGS. 2 and 3, it will be seen that spaced downwardly from the upper end 31 of each pin 28, is a groove 36 which extends circumferentially around the pin. A plastic collar 37 is molded around the upper end of pin 28, the upper surface of collar 37 being approximately at the same elevation as upper end 31 and the lower end being substantially below groove 36. By reason of the molding process, there is an inward protrusion 38 of the collar 37 which substantially fills groove 36. Thus collar 37 and pin 28 are secured together. Therefore, on upward movement of punch plate 22 upon reverse oscillation of crank 15, the shoulders 34 engage under the plastic collar 37 to raise the punch pin 28 from its depressed position to its retracted position.

A suitable plastic material for collar 37 is an unfortified polycarbonate. A suitable material for the punch pin 28 is an alloy steel, suitably heat treated to a satisfactory hardness.

Figure 4:
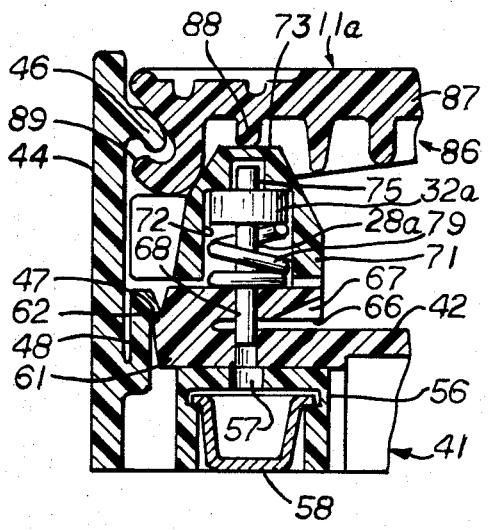
FIG. 4 is a fragmentary sectional view of a portion of an alternate punch mechanism.

FIG. 4 shows another punch with which the present invention may be used. A feature of the punch shown in FIG. 4 is that it is molded of plastic material although it will be understood that a metal could be substituted. Directing attention now to FIG. 4, a feature of the punch illustrated is that the parts may snap into place and be held assembled without the use of separate fasteners. However, although this feature has numerous advantages over prior punches, these particular features are not essential to the present invention and it will be understood that other punch structures may be used with the punch pins **28*a*** hereinafter described in detail.

Punch **11*a* has a base 41 having an upwardly-rearwardly slanted platen 42 to support pages to be bound. Extending vertically upward of base 41 is a back 44. Spaced below the top edge of back 44 are downward directed hooks 46. Near the bottom of back 44 are catches 47 on the ends of vertically extending catch arms 48. Catches 47 may move forward and and rearward by reason of flexibility of arms 48**.

Extending transversely of base 41 is a support 56 in the shape of an inverted channel, having longitudinally spaced apart holes 57, larger than the holes which the device is intended to punch. The top of support 56 is below the elevation of the rear of platen Below support 56 and fitting within its channel shap is a slup receiving receptor 58 which catches the punched circles which drop through holes 57. Various means may be used to retain the receptor 58 within the support 56.

Resting upon support 56 is transverse die bar 61 which has ledges 62 at its rear. Catches 47 engage ledges 62 and restrain bar 61 from being lifted.

Die bar 62 has a throat 66 formed therein which is at the level of platen 42. The depth of throat 66 determines the distance from the rearward edge of the paper being punched that the holes formed therein are located. To assist the paper entering the throat 66, there is a downward-rearward slanted guide 67 above the platen 42. Bores 68 are formed in the die bar 61 extending down through the body of the die bar into registry with the holes 67. It will be seen that the bores 68 intersect throat 66.

Vertically reciprocating above die bar 61 is a transverse punch bar 71 having cavities 72 corresponding in number to the bores 68 formed extending upward from its bottom surface in alignment with bores 68. Each cavity 72 has a lesser diameter upward extension 75. The punch bar 71 has a flat top 73.

Received in each cavity 72 is a punch pin 28*a* formed with a male punch die 29*a* at its bottom end. Near the top 31*a* of each pin 28*a* is a collar 32*a* formed of a plastic material similar to the head 32 of the preceding modification. Thus, there is a groove 36*a* formed in pin 28*a* spaced downwardly from the upper end 31*a* thereof. The plastic molded collar 37*a* has an inward protrusion 38*a* which substantially fills the groove 36*a*.

Coil springs 79 at their upper ends bear against collar 37*a*. The lower ends of the springs 79 bear against the die bar 61. The portions of the ends 28*a* above the collar 22*a* extend into extension 75. Hence the springs 79 bias the punch pins 28*a* upward in the cavity 72 and also bias the punch bar 71 upwardly.

In operation of the punch, the user depresses the lever 87, causing the punch to move to the position illustrated in FIG. 4 with the punch bar 71 depressed and the punch pins 28*a* depressed to punch sheets inserted in throat 68 as has heretofore been explained. When the lever 87 is released, springs 79 return handle 86 to its upward position, the springs 79 bearing against the collar 37*a* to raise the pins 28*a*.

Figure 5:
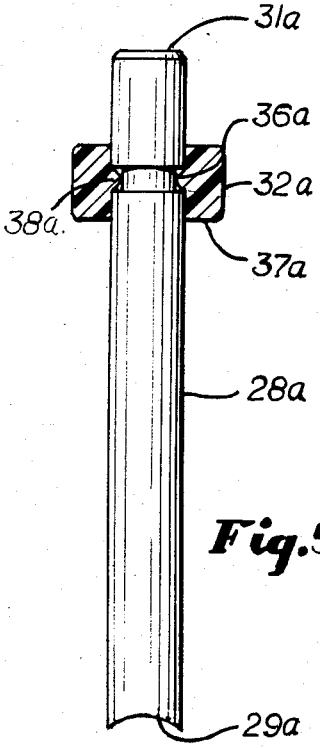
FIG. 5 is an enlarged elevational view of the pin used in the modification of FIG. 4 with the collar broken away in section.

The pin of FIG. 5 resembles that of FIGS. 2–3 and the same reference numerals followed by subscript a designate corresponding parts.

What is claimed is:

1. In a punch, a first plate formed with a first hole, a guide plate spaced from said first plate by a gap, said guide plate being formed with a second hole aligned with said first hole; a punch pin, said punch pin comprising a metal rod having a first end formed as a male punch and a second end, said rod formed with a groove vicinal said second end and a plastic collar molded around said rod having a protuberance substantially filling said groove and the surface of said collar closest to said first end, having a substantially flat surface perpendicular to said rod, the thickness of said collar being substantially less than the length of said rod; said punch pin being reciprocable through said first and second holes, first means engaging said second end to push said first and through said first hole to punch paper in said gap, and second means applying force to said first-mentioned surface of said collar to retract said punch pin away from said first plate, said first means compriseing a punch plate, said punch plate being formed with a slot having an edge to engage said second end of said rod and said second means comprising shoulders on said slot engaging said flat surface of said collar.

* * * * *